US005951444A

United States Patent [19]

Webber

[11] Patent Number: 5,951,444

[45] Date of Patent: Sep. 14, 1999

[54] CABLE AND PULLEY LINKAGE FOR EXERCISE MACHINE

[76] Inventor: Randall T. Webber, 11162 Morning Creek Dr, San Diego, Calif. 92128

[21] Appl. No.: 08/977,189

[22] Filed: Nov. 24, 1997

[51] Int. Cl.[6] ..... A63B 21/00

[52] U.S. Cl. ..... 482/99; 482/138; 254/399

[58] Field of Search ..... 482/92, 94–103, 482/112, 113, 120, 129, 130, 133, 135–138; D21/673, 675, 676; 254/337, 393, 399

[56] References Cited

U.S. PATENT DOCUMENTS

| | | | |
|---|---|---|---|
| Re. 34,572 | 3/1994 | Johnson et al. . | |
| 480,271 | 8/1892 | Newton . | |
| 676,771 | 6/1901 | Reach . | |
| 931,699 | 8/1909 | Medart . | |
| 3,708,166 | 1/1973 | Annas . | |
| 4,598,907 | 7/1986 | Ross . | |
| 4,634,118 | 1/1987 | Jensen . | |
| 4,902,006 | 2/1990 | Stallings, Jr. . | |
| 5,201,694 | 4/1993 | Zappel . | |
| 5,236,406 | 8/1993 | Webber . | |
| 5,316,534 | 5/1994 | Dalebout et al. . | |
| 5,441,470 | 8/1995 | Chen | 482/96 |
| 5,527,245 | 6/1996 | Dalebout et al. . | |

FOREIGN PATENT DOCUMENTS

| | | | |
|---|---|---|---|
| 410328 | 3/1966 | Switzerland | 254/393 |

OTHER PUBLICATIONS

AMF American Lifestyler Brochure, 1983.

Eagle Lateral Raise Brochure and Price List, 1986.

*Primary Examiner*—John Mulcahy

*Attorney, Agent, or Firm*—Brown, Martin, Haller & McClain, LLP

[57] ABSTRACT

A cable and pulley assembly has a first floating pulley unit having a pulley housing and a pair of pulleys rotatably mounted side-by-side in the housing for rotation about a single pulley axis, and a second floating pulley unit having a pulley housing and at least one pulley rotatably mounted in the housing. A first cable is linked to the housing of the first floating pulley unit, and a second cable is linked to the housing of the second floating pulley unit. A third cable extends around one of the side-by-side pulleys in the first pulley unit, around the pulley of the second pulley unit, and around the other side-by-side pulley of the first pulley unit. The resistance on the first cable is then four times that on each section of the third cable, and plural pull points are provided for selective connection to exercise stations.

28 Claims, 5 Drawing Sheets

RECEIVED
JUN 1 6 1999
Publishing Division

CABLE AND PULLEY LINKAGE FOR EXERCISE MACHINE

BACKGROUND OF THE INVENTION

The present invention relates generally to weight lifting exercise machines, and is particularly concerned with a cable and pulley linkage apparatus for coupling a load to various exercise stations in such a machine.

A typical exercise or weight machine has a support frame, a load such as a weight stack mounted on the frame, and various different exercise stations linked to the load, usually by means of a cable and pulley system consisting of a series of fixed and floating pulleys around which one or more cables extend. Such a machine is described in my U.S. Pat. No. 5,236,406, for example, the contents of which are incorporated herein by reference.

One problem with existing cable and pulley linkages is that a large number of pulleys is required to link a weight stack to several exercise stations, and the more pulleys you provide, the greater the space that is required. Additionally, there is a limit to the resistance ratio and the number of pulling points which can be achieved with current floating pulley arrangements. A 3 to 1 resistance ratio is the maximum which can be achieved in most current systems.

SUMMARY OF THE INVENTION

It is an objective of the present invention to provide a new and improved cable and pulley linkage system for weight lighting exercise machines.

According to the present invention, a cable and pulley linkage system is provided, which comprises a floating double pulley having a support bracket and a pair of pulleys rotatably mounted on the same pivot axis on the support bracket in a side-by-side arrangement, a second floating pulley having at least one pulley, a first cable secured to the second floating pulley providing a first pulling point, a second cable secured to the double floating pulley providing a second pulling point, and a third cable extending around the single and double floating pulleys and providing third and fourth pulling points, whereby the system has at least four pulling points for selective connection to a load and exercise stations.

In one possible arrangement, the first cable is linked to a load such as a weight stack (100% load), the second cable is linked to a first exercise station, and the third cable extends around one of the pair of floating pulleys, then around the single floating pulley, and finally around the other of the pair of floating pulleys, providing two pulling points which may both be connected to exercise stations, or to one exercise station and one fixed point or cable tie-off, or to two cable tie-offs. In each case, the first exercise station has a 2 to 1 resistance ratio (200% of load), and the third cable has a 50% load at one or both ends.

In an alternative embodiment, a third pulley is secured to the double pulley support bracket beneath the pair of pulleys. In this case, the second cable extends around the third pulley to provide two pulling points at 100% of load each. These may both be connected to exercise stations, or one may be connected to a fixed cable tie-off.

The second floating pulley assembly may be a single pulley, or alternatively may comprise a pair of vertically aligned pulleys. In this case, the first cable extends around the uppermost pulley of the pair to provide two pulling points, one of which may be linked to the load or weight stack. This arrangement provides a 4 to 1 resistance ratio between the first cable and the second cable, where the first floating pulley assembly has a double pulley only. Alternatively, where a third pulley is mounted on the first floating pulley assembly, two pulling points at a 2 to 1 resistance ratio are provided. At the same time, the third cable in this arrangement provides two pulling points at 100% of load, or 1 to 1, and the second cable provides a third 100% pulling point.

This system permits as many as five exercise stations to be linked to a resistance or load with a cable and pulley system where the pulleys are in line, on top of one another, rather than spreading out sideways as was necessary in the past. It therefore takes up much less space on the frame. Also, much fewer pulleys and pulley support brackets are required, and the streamlined design will enhance the appearance of the overall machine. The ability to provide two 2 to 1 resistance cables in one floating pulley was also not an option in previous systems.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

FIGS. 1A to 1F illustrate the capabilities of some of the prior art pulley and cable systems, so that they may be compared to the cable and pulley systems of this invention as illustrated in FIGS. 2 to 11.

Figures 1, 1A, 1B, 1C, 1D, 1E, 1F:
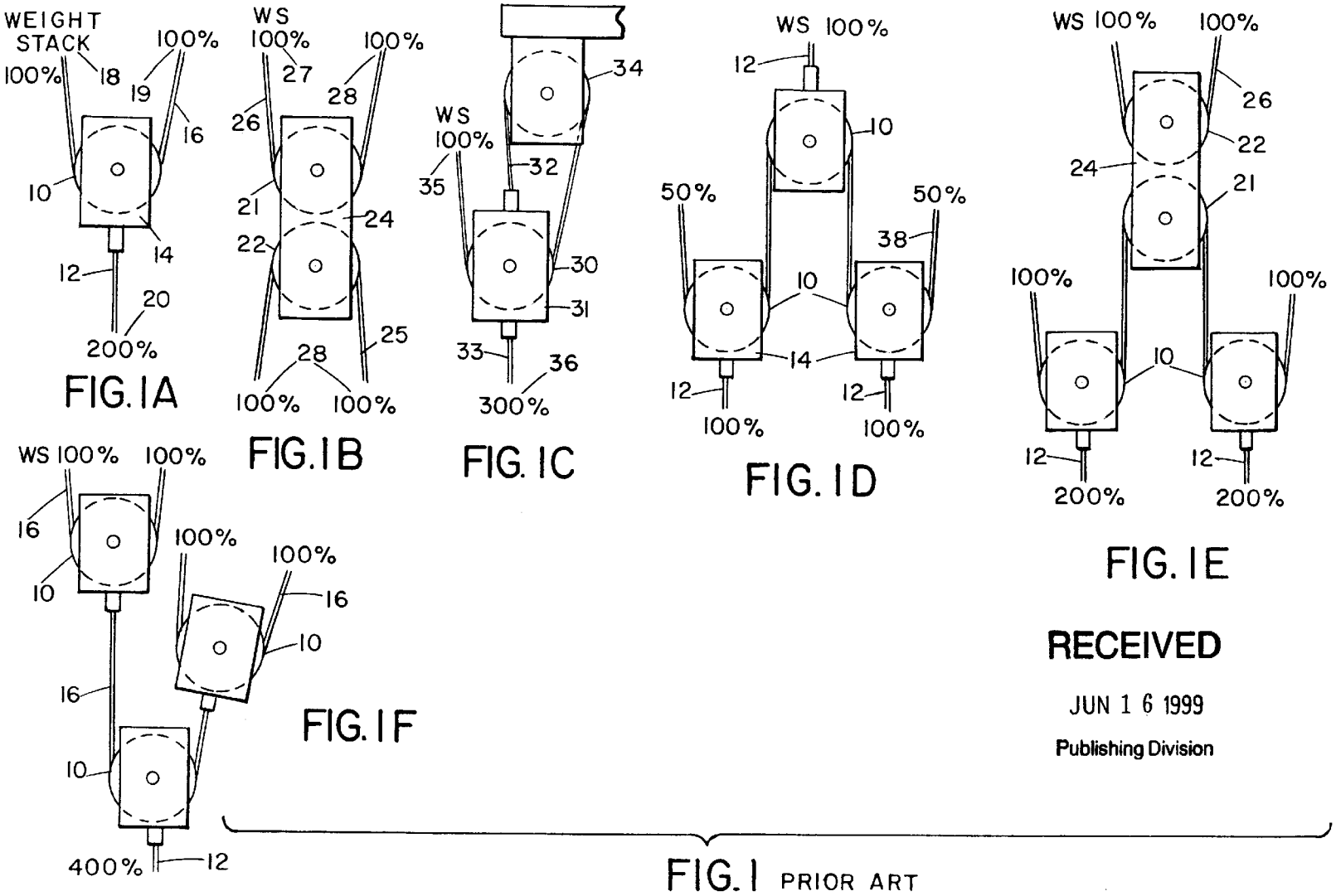
FIG. 1 PRIOR ART
FIGS. 1A to 1C illustrate three basic prior art floating pulleys used in prior art cable and pulley systems.
FIGS. 1D to 1F illustrate various prior art cable and pulley systems using these floating pulleys.

FIG. 1A illustrates a simple, prior art single floating pulley 10 with a first cable 12 linked to the pulley housing 14 and a second cable 16 extending around the pulley. This arrangement provides one weight stack or load connection point 18 and two possible exercise pulling points 19,20, one at a 100% or 1:1 resistance ratio, and one at a 200% or 2:1 resistance ratio. The single floating pulley may be reversed, with point 20 attached to the load and points 18,19 providing two 50% or 1:2 resistance ratios.

In FIG. 1B, a prior art double floating pulley is illustrated in which two pulleys 21,22 are stacked vertically one on top of the other in pulley housing 24. In this case, a first cable 25 extends around one of the pulleys and a second cable 26 extends around the other pulley, providing one weight stack or load attachment 27 and three 100% or 1:1 pulling points 28.

FIG. 1C illustrates another prior art floating pulley arrangement. In this arrangement, a single floating pulley 30 is mounted in a housing 31 to which two, oppositely directed cables 32,33 are secured. One of the cables 32 extends around a fixed pulley 34, then back around the single floating pulley 30. If the free end 35 of this cable is secured to the load or weight stack, the pulling point 36 on cable 33 has a 300% or 3:1 resistance ratio.

Thus, existing floating pulleys can provide resistance ratios of 1:2 (50% of load), 1:1 (100% of load), 2:1 (200% of load), and 3:1 (300% of load).

FIGS. 1D to 1F illustrate some prior art cable and pulley systems using combinations of these floating pulleys. FIG. 1D illustrates a combination of three single floating pulleys 10 in which each pulley has a single cable 12 connected to housing 14, and a cable 38 extends around all three pulleys 10. If the central cable 12 is connected to the weight stack, the opposite ends of cable 38 provides two 50% pulling points, while each of the other two cables 12 provide a 100% pulling point.

In FIG. 1E, a combination of two single floating pulleys 10 and a double floating pulley 21,22,24 is illustrated. In this case, the cable 25 extending around the lowermost pulley 21 of the double floating pulley has opposite ends extending around respective single floating pulleys 10. In this combination, one end of cable 26, for example, can be connected to the weight stack, providing a 100% pulling point at the opposite end of cable 26 as well as at each end of cable 25. Each cable 12 will provide a 200% pulling point.

FIG. 1F illustrates an alternative arrangement of three single floating pulleys 10 to provide three 100% pulling points and one 400% pulling point.

In each of these floating pulley combinations, the floating pulleys spread out sideways to increase the number of pulling points, considerably increasing space requirements. Additionally, at least three floating pulleys and pulley housings are needed to provide four pulling points, and additional floating pulleys must be provided for additional exercise stations, thus the system spreads out sideways even more in such arrangements, increasing space requirements.

Figure 2:
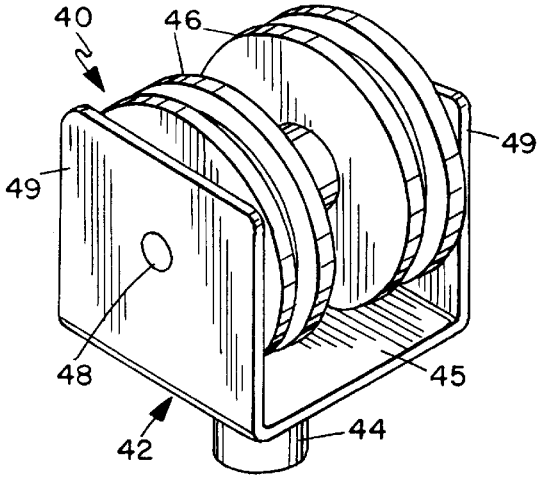
FIG. 2 is a perspective view of a double floating pulley assembly forming part of some embodiments of the cable and pulley system of this invention.
Figure 3:
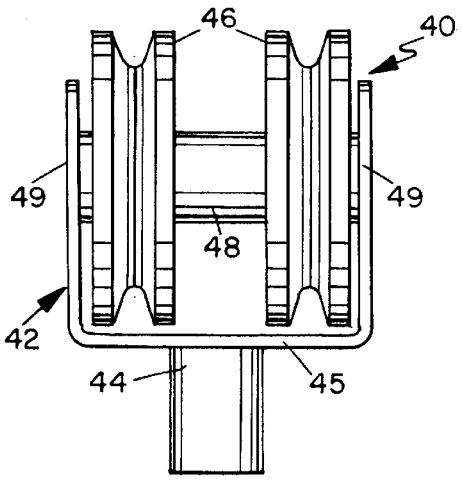
FIG. 3 is an end elevational view of the pulley assembly of FIG. 2.
Figure 4:
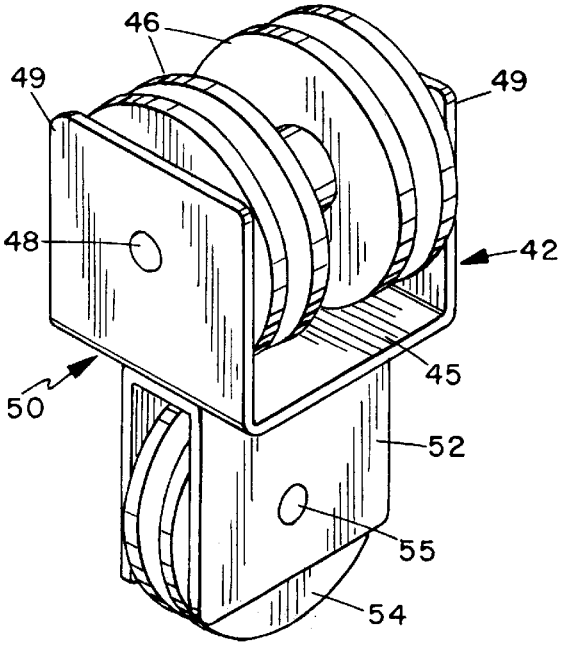
FIG. 4 is a perspective view of a triple floating pulley assembly according to another embodiment of the invention.

FIGS. 2 to 4 of the drawings illustrate two alternative floating pulley devices 40,50, respectively, of the present invention which are at the heart of each of the alternative embodiments of the cable and pulley linkage of the invention as illustrated in FIGS. 5 to 10. FIGS. 2 and 3 illustrate a double floating pulley device 40 according to a first embodiment and FIG. 4 illustrates a triple floating pulley device 50 according to a second embodiment of the invention. The double floating pulley device 40 basically comprises a generally U-shaped pulley housing 42 having a cable tie-off 44 extending from its base wall 45. A pair of side-by-side pulleys 46 are rotatably mounted on a single pulley axle 48 extending between the side walls 49 of the pulley housing. This pulley device is used in the cable and pulley linkage systems of FIGS. 5,8,9 and 11.

The triple floating pulley device 50 illustrated in FIG. 4 is a modification of the double floating pulley device of FIGS. 2 and 3, and like reference numerals are used for like parts as appropriate. However, the cable tie-off 44 is replaced with a single pulley housing 52 in which a single pulley 54 is rotatably mounted for rotation about an axis 55 perpendicular to the double pulley axle or axis 48.

The double and triple floating pulley units of FIGS. 2 to 4 may be used in a number of different configurations to produce a more versatile and compact pulley and cable linkage for a multiple station, weight lifting exercise machine. Some of these alternatives are illustrated in FIGS. 5 to 11. In these embodiments, like reference numerals have been used for like parts as appropriate.

Figure 5:
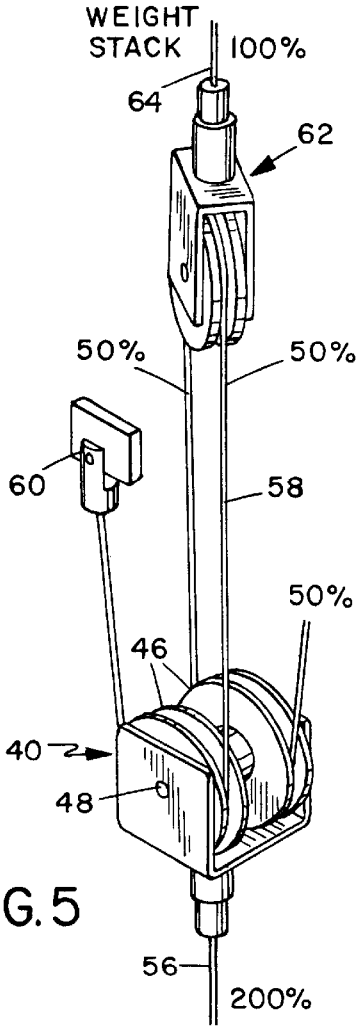
FIG. 5 is a perspective view of a first cable and pulley system according to one embodiment of the invention using the double pulley assembly of FIGS. 2 and 3.

One possible linkage using the double floating pulley unit 40 is illustrated in FIG. 5. In this linkage, a first cable 56 is secured to the cable tie-off 44 and a second cable 58 extends from a fixed point or tie off 60 on the frame, or a movable arm, around a first one of the pair of pulleys 46, then around a single floating pulley 62 positioned above the double pulley unit 40, and finally back around the second one of the pulleys 46. The free ends of cables 56 and 58 can be connected to different exercise stations, while a third cable 64 connects the single pulley unit 62 to a load such as a weight stack. A 1:2 or 50% resistance is thus provided at the end of cable 58, while a 2:1 or 200% resistance is provided at the end of cable 56.

The arrangement of FIG. 5 may be connected in different configurations. For example, both ends of cable 58 may be connected to exercise stations, providing two 50% pull points as well as the 200% pull points. In another alternative, both ends of cable 58 may be connected to fixed points on the frame, or tie-offs 60, providing a single 2:1 or 200% exercise pull point. Alternatively, tie-offs 60 may be on one or more movable arms.

Figure 6:
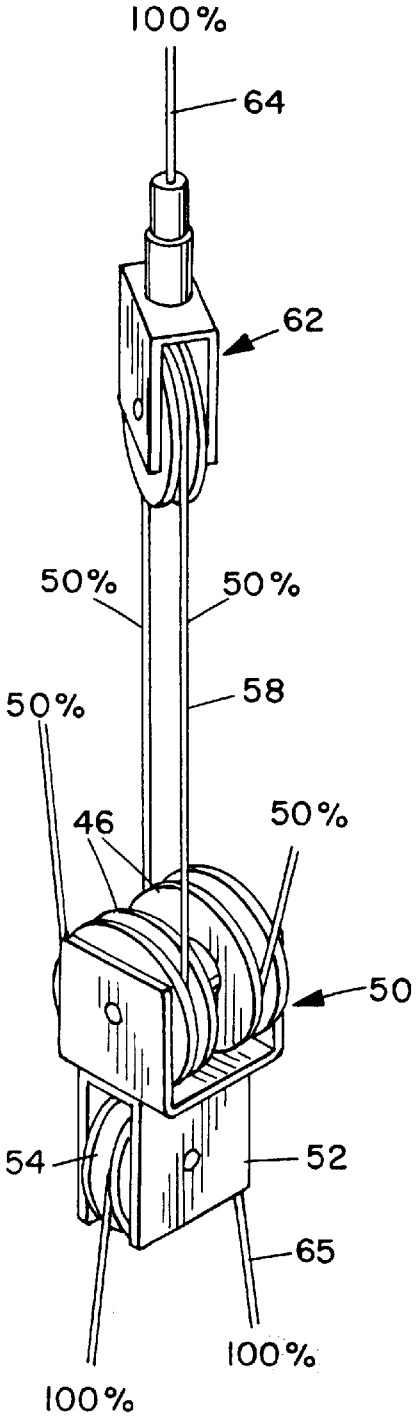
FIG. 6 is a perspective view of a second cable and pulley system according to another embodiment of the invention, using the triple pulley assembly of FIG. 4.

FIG. 6 illustrates another possible cable and pulley linkage which uses the triple floating pulley unit 50 in combination with a single floating pulley 62 as in the previous embodiment. A first cable 65 extends around the lower, single pulley 54 of unit 50, while the cable 58 is arranged as in the previous embodiment, extending around one of the two pulleys 46, then around the single pulley 62, and then back down around the second of the pulleys 46. In the illustrated embodiment, both ends of cable 58 are connected to exercise stations, cable 64 is connected to the weight stack, and both ends of cable 65 are also connected to exercise stations, providing four pull points in an in-line arrangement. Each end of cable 58 will have a 1:2 or 50% resistance while each end of cable 65 has a 1:1 or 100% resistance.

Figure 7:
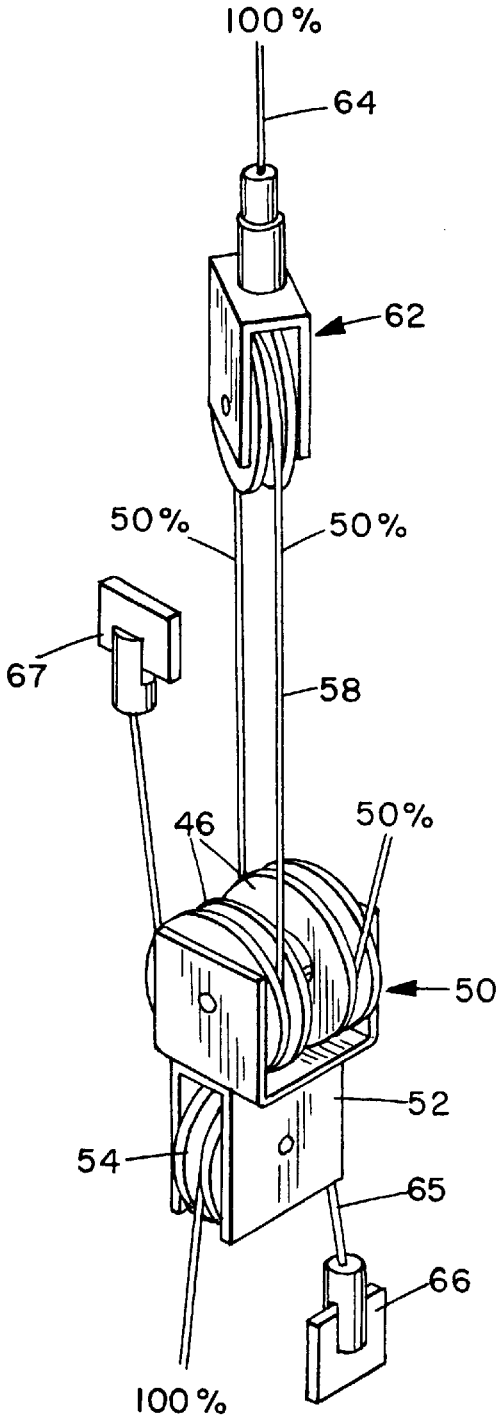
FIG. 7 is a perspective view illustrating a modification of the system of FIG. 6.

The cables in FIG. 6 can also be connected differently to provide different combinations of pull points. For example, one or both ends of cable 58 may be connected to fixed tie-offs or movable arms, if a reduced number of exercise stations are involved. FIG. 7 illustrates another alternative in which one end of cable 65 is connected to a fixed tie-off or movable arm 66, and one end of cable 58 is also connected to a fixed tie-off or movable arm 67, so that the opposite ends of cables 65 and 58 can be used as 100% and 50% pull points, respectively, at different exercise stations. In this case there are only two exercise stations. Alternatively, both ends of cable 58 may be connected to exercise stations, providing three pull points or exercise station connections, two at 50% and one at 100%.

Figure 8:
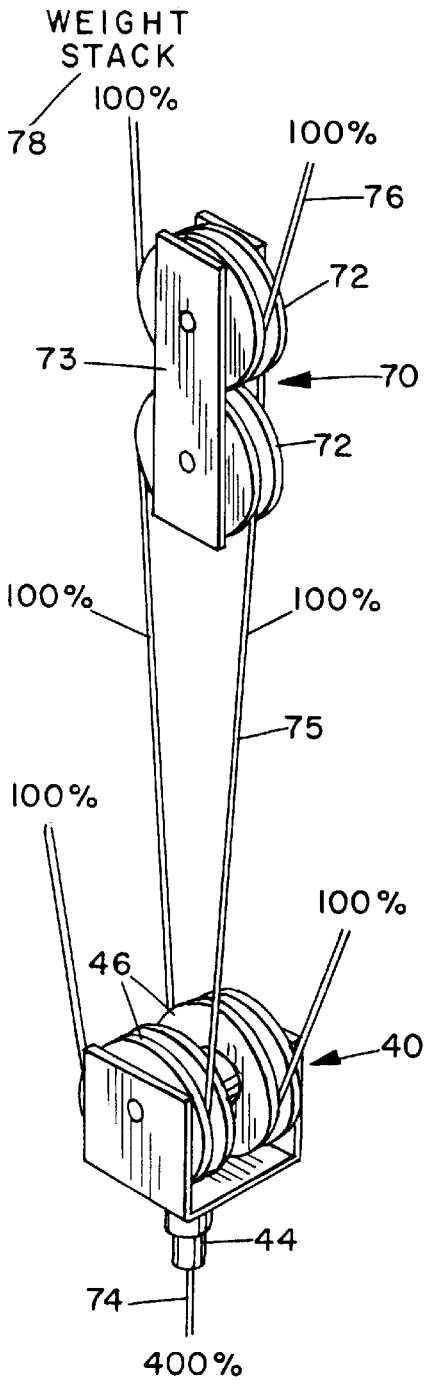
FIG. 8 is a perspective view of a third cable and pulley system utilizing the double pulley assembly of FIGS. 2 and 3.

FIG. 8 illustrates another alternative cable and pulley assembly using the double floating pulley unit 40 of FIGS. 2 and 3 in combination with a double floating pulley unit 70 which has two pulleys 72 positioned in a vertically spaced configuration, with the pulleys in line on top of one another, in a pulley housing 73. The vertically stacked double pulley unit 70 is spaced above the side-by-side floating pulley unit 40. A first cable 74 is connected to the tie-off 44 at the bottom of unit 40. A second cable 75 extends around one of the two pulleys 46, then around the lowermost of the pulleys 72, and then back around the other of the two pulleys 46. A third cable 76 extends around the uppermost pulley 72 of unit 70. In this assembly, one end 78 of cable 76 is preferably connected to the load or weight stack. The other four cable ends may be connected to exercise stations, if desired. The other end of cable 76 and both ends of cable 75 each have a 1:1 resistance ratio, or 100% of load, as indicated in the drawing. The end of cable 74 will have a 4:1 resistance ratio, i.e. 400% of load. Therefore, this cable and pulley assembly increases the resistance of an incoming, load-bearing cable by four times, in a compact, in line arrangement, which was not possible in any prior art cable and pulley systems.

Figure 9:
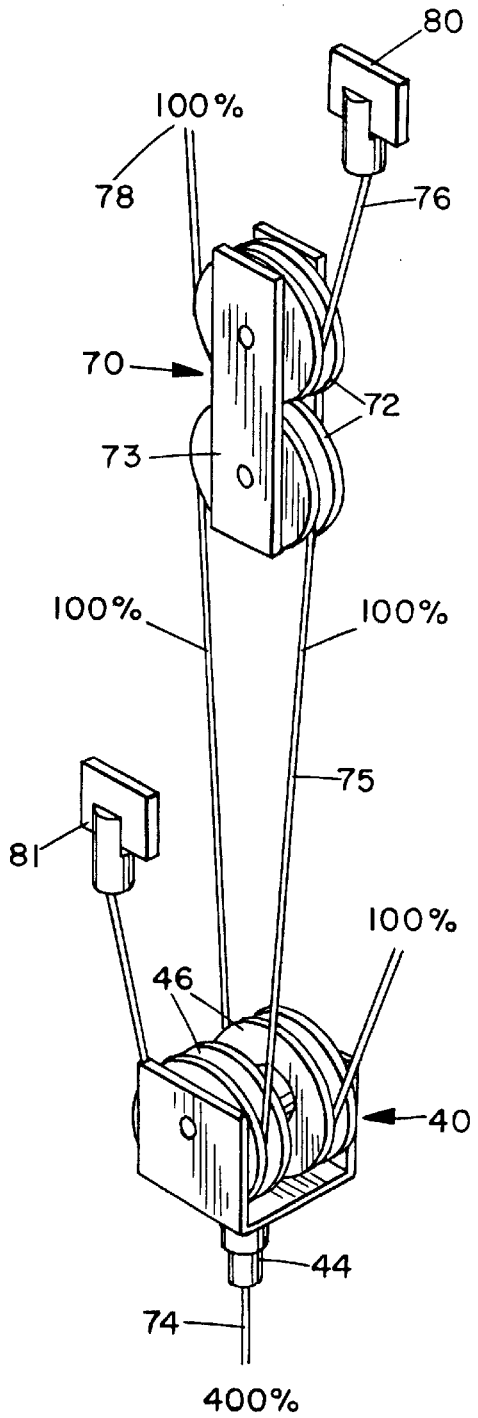
FIG. 9 is a perspective view illustrating a modification of the system of FIG. 8.

Instead of connecting both ends of cable 75 to exercise stations, as in FIG. 8, one or both ends of cable 75 may be connected to a fixed tie-off point or bracket on the support frame of the exercise machine, if fewer exercise stations are used, or to a moveable arm. FIG. 9 illustrates another modification of the assembly of FIG. 8, in which the opposite end of cable 76 to the load is connected to a fixed tie-off or bracket 80, and one end of cable 75 is also connected to a fixed tie-off or bracket 81. In each of these alternatives, the lower cable 74 still has a 4:1 resistance ratio, or 400% of load, and two or three additional pull points at 100% are provided.

Figure 10:
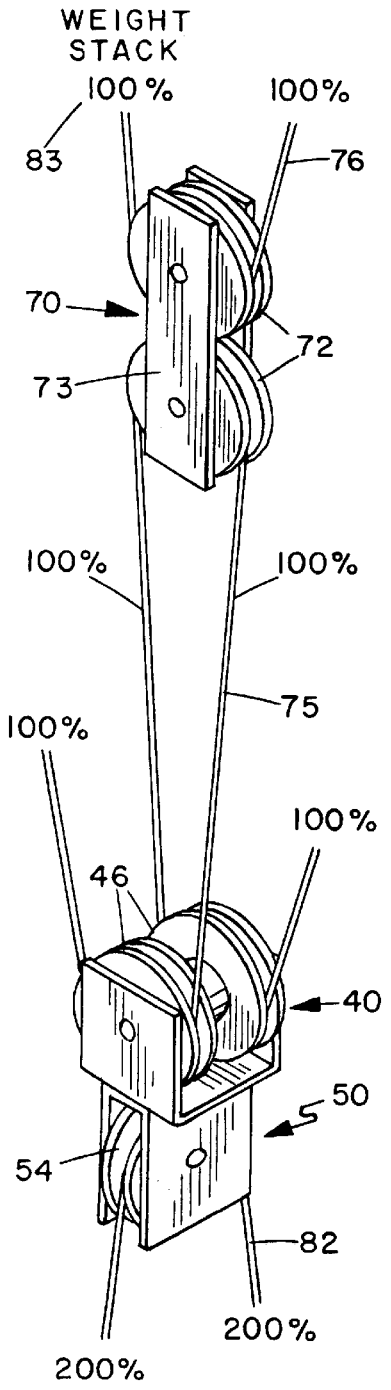
FIG. 10 is a perspective view of a cable and pulley system according to another embodiment of the invention, using the triple pulley assembly of FIG. 4.

FIG. 10 illustrates another modified cable and pulley assembly which uses a double, vertically stacked floating pulley 70 as in FIG. 8 and 9, but in combination with the triple floating pulley unit 50 rather than the double pulley unit 40. As in the previous embodiment, upper cable 76 extends around the uppermost pulley 72, and a cable 75 connects the lowermost pulley 72 to the side by side pulleys 46 of pulley unit 50. As in the previous embodiment, cable 75 extends around one of the pulleys 46, lowermost pulley 72, and then around the other pulley 46. A cable 82 extends around the lower pulley 54 of the triple pulley unit 50. One end 83 of cable 76 may be connected to the load or weight stack, and up to five exercise stations may be connected to the other cable ends, i.e. the opposite end of cable 76 and each end of the cables 75 and 82.

In this arrangement, the free end of cable 76 has a 1:1 resistance ratio, or 100% of load, as do the opposite ends of cable 75. The opposite ends of the lowermost cable 82 each have a 2:1 resistance ratio, or 200% of load. This assembly provides pull points for up to five exercise stations in a simple, in line arrangement, whereas in the past such a large number of exercise stations would have required a cable and pulley system which extended sideways and took up much more room than the illustrated assembly.

There are a number of possible configurations for the cable ends of the assembly of FIG. 10. In the illustrated embodiment, each cable end apart from the load bearing cable end is connected to an exercise station. However, one or both ends of the central cable 75 may be connected to a fixed tie-off on the frame, or to a moveable arm, providing only one or two 100% pull points rather than three as in FIG. 10. This may be appropriate for machines having less than five exercise stations, for example. Alternatively, one or both ends of the lower cable 82 may be connected to a fixed tie-off, providing one 200% pull point or only 100% pull points, as desired. In another possible alternative, one end of cable 75 and one end of cable 82 may be connected to a fixed tie-off. This arrangement would provide two 100% pull points and one 200% pull point. In another alternative, both ends of cable 75 and one end of cable 82 may be connected to fixed tie offs, providing one 100% pull point at the free end of cable 76 and one 200% pull point at the free end of cable 82.

In another possible alternative, the opposite end of cable 76 to the load may be connected to a fixed tie-off, with both ends of each of the cables 75 and 82 connected to exercise stations, or with one or more of these cable ends connected to fixed tie-offs, depending on the number and location of pull points required. The cable ends may alternatively be connected to a moveable arm rather than to a fixed tie-off.

The cable and pulley assembly of FIG. 10 therefore has great versatility, permitting any number of exercise stations from two to five to be connected to the assembly, in various combinations of 100% and 200% resistance as desired. The assembly is simple and compact, with only two floating pulley units linked in line without spreading sideways which is normally the case in systems involving four or more pull points or exercise stations.

Figure 11:
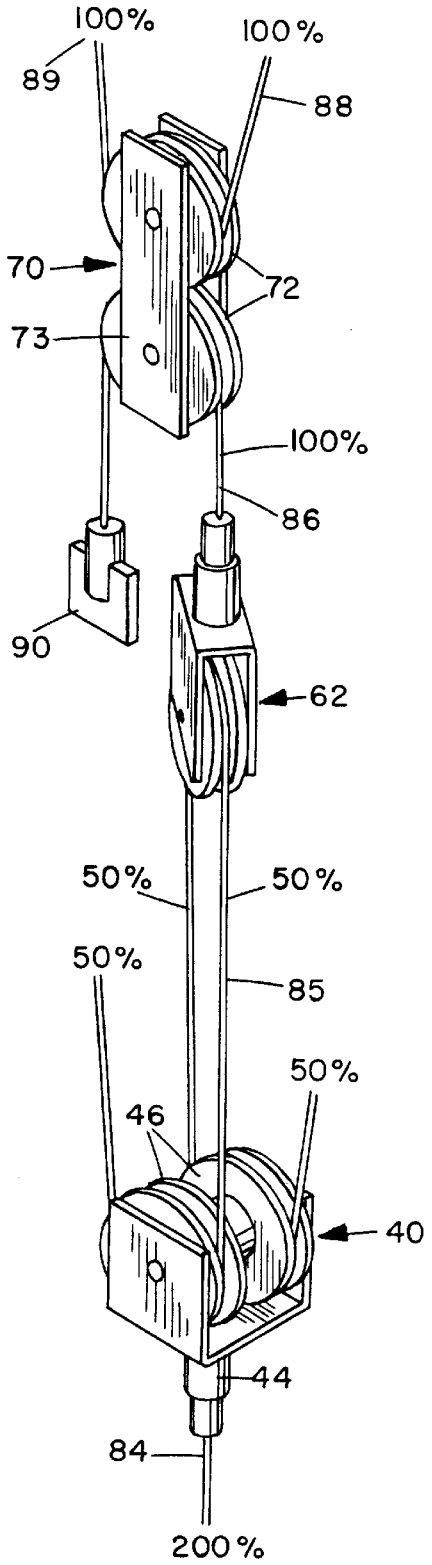
FIG. 11 is a perspective view of another embodiment of the cable and pulley system.

FIG. 11 illustrates another alternative cable and pulley assembly, which is similar to that of FIG. 9, combining the double, side-by-side pulley unit 40 with a double, vertically spaced pulley unit 70, but includes an additional, single floating pulley unit 62 between units 40 and 70. In this assembly, a first cable 84 is connected to the cable tie-off 44 of unit 40, a second cable 85 extends between unit 40 and the single floating pulley unit 62, a third cable 86 extends between unit 62 and the lowermost pulley 72 of unit 70, and a fourth cable 88 extends around the uppermost pulley 72 of unit 70.

In the illustrated embodiment, a number of pull points which are vertically spaced and in line are provided. One end 89 of cable 88 may be connected to a weight stack. The other end of cable 88 may be connected to an exercise station at a 1:1 resistance ratio (100% of load). Cable 86 has one end secured to the housing of single cable unit 62, and the opposite end is secured to a cable tie-off 90, which may be on the fixed frame of the exercise machine, or on a movable arm. Alternatively, the free end of cable 86 may be connected to an exercise station, and in this case it will have a 1:1 resistance ratio, or 100% of load.

The opposite ends of cable 85 may each be linked to exercise stations, and will each provide a 1:2 resistance ratio, or 50% of load. Alternatively, one or both ends of cable 85 may be connected to a cable tie-off mounted either on the fixed frame of the machine or on a movable arm. The end of cable 84 may be linked to an exercise station to provide a 2:1 exercise ratio, or 200% of load.

The assembly of FIG. 11 provides an arrangement of three floating pulley units in line, one on top of the other, providing up to five pull points for appropriate connection or linkage to exercise stations, with resistance ratios of 1:1,2:1, and 1:2. In an alternative assembly (not illustrated), the double pulley unit 40 may be replaced with the triple pulley unit 50 of FIG. 4, providing one more pulling point, in an equivalent manner to FIGS. 7 and 10. In this case, a cable will pass around the lowermost pulley 54 of the 35 triple pulley unit to provide two possible pull points at 100% of load each. One or more of the cable ends in this arrangement may also be selectively connected to a cable tie-off on the frame or a movable arm.

The cable and pulley assembly of this invention requires less pulleys and pulley housings to provide a plurality of possible pull points at varying resistance ratios of 1:2, 1:1, 2:1, and 4:1. The design is relatively compact, since two or more floating pulley units are positioned in line on top of one another, instead of spreading out sideways as in prior art arrangements. This provides a much less bulky and more pleasant appearance in the machine. The assembly can provide a resistance ratio of up to 4:1, as in FIGS. 8 and 9, and can provide two, three, four, five or six pull points for linking to various exercise stations, as desired. A number of the alternatives provide two 2:1 resistance cables or pull points in a single floating pulley, such as the assembly of FIG. 10. This invention provides a double, side-by-side pulley unit or triple floating pulley unit in combination with at least one additional floating pulley unit in a large number of different possible configurations. Additionally, the triple floating pulley unit 50 provides more pulling points from a single location than was possible in any prior art arrangement.

It will be understood that the alternative cable and pulley assemblies of FIGS. 5 to 11 are just some of the possible configurations which may be obtained by combining the floating pulley unit 40 and/or 50 with other single or double pulley units. The double, side-by-side pulley unit 40 in combination with a cable fed around both pulleys provides two pulling points with the original resistance, and a third pulling point with four times the original resistance (see FIG. 8 and 9), or in the triple unit of FIG. 4, two pulling points with two times the original resistance (e.g. FIG. 10).

The side-by-side pulley unit of this invention, in combination with a cable that feeds around both of the side-by-side pulleys, gives more pulling points and the ability to perform more exercises off a single load or weight stack. Numerous possible variations are possible, depending on what resistance is desired at each of the pulling points, and combinations with pulling points at various different resistances are possible.

Although some preferred embodiments of the invention have been described above by way of example only, it will be understood by those skilled in the field that modifications may be made to the disclosed embodiments without departing from the scope of the present invention, which is defined by the appended claims.

I claim:

1. An exercise machine, comprising:

a load for providing an exercise resistance;

at least two exercise stations;

a cable and pulley assembly linking the load to the exercise stations;

the cable and pulley assembly comprising;

a first floating pulley unit having a pulley housing and a pair of pulleys rotatably mounted side-by-side in the housing for rotation about a single pulley axis, the first floating pulley unit having first and second sides on opposite sides of said pulley axis;

a second floating pulley unit having a pulley housing and at least one pulley rotatably mounted in the housing;

a first cable linked to the housing of the first floating pulley unit;

a second cable linked to the housing of the second floating pulley unit; and a third cable extending in a cable path which travels first around one of the side-by-side pulleys in the first pulley unit, then directly from said one side-by-side pulley around the pulley of the second pulley unit, and then directly from the pulley of the second pulley unit around the other side-by-side pulley of the first pulley unit, whereby four lengths of said third cable extend from the first side of said first floating pulley unit and said first cable extends from the second side of said first pulley unit;

whereby the cable and pulley assembly has at least four cable ends for selective connection to the load and exercise stations, the four cable ends comprising at least a first end of the first and second cable and opposite ends of the third cable.

2. The machine as claimed in claim 1, comprising three exercise stations, the first end of the second cable being linked directly to the load, the first end of the first cable and both ends of the third cable being linked directly to the respective exercise stations.

3. The machine as claimed in claim 1, including at least one cable tie-off, the first end of the second cable being linked directly to the load, the first end of the first cable and one end of the third cable being linked to exercise stations, and the other end of the third cable being connected to the cable tie-off.

4. The machine as claimed in claim 1, including two cable tie-offs, the first end of the second cable being linked directly to the load, the first end of the first cable being linked to one of the exercise stations, and both ends of the third cable being anchored at respective cable tie-offs.

5. The machine as claimed in claim 1, wherein the first pulley unit has a third pulley pivotally secured to the pulley housing beneath the side-by-side pulleys for rotation about a third pulley axis, and the first cable extends around the third pulley to provide two cable ends for selective connection to the respective exercise stations.

6. The machine as claimed in claim 5, wherein both ends of the first cable are connected to the respective exercise stations and the second cable is connected to the load.

7. The machine as claimed in claim 6, wherein both ends of the third cable are connected to the respective exercise stations.

8. The machine as claimed in claim 6, including at least one cable tie-off, one end of the third cable being connected to one of the exercise stations and the other end of the third cable being connected to the cable tie-off.

9. The machine as claimed in claim 5, including at least one cable tie-off, the first end of the first cable being connected to one of the exercise stations and the other end of the first cable being connected to the cable tie-off, and the second cable is being connected to the load.

10. The machine as claimed in claim 9, wherein both ends of the third cable are connected to exercise stations.

11. The machine as claimed in claim 9, including at least one cable tie-off. one end of the third cable being connected to one of the exercise stations and the other end of the third cable being connected to the cable tie-off.

12. The machine as claimed in claim 1, including at least three exercise stations, wherein the second floating pulley unit has an upper pulley and a lower pulley pivotally mounted in the housing in a vertically spaced arrangement, the second cable extending around the upper pulley and the third cable extending around the lower pulley of the second floating pulley unit, whereby at least five cable ends are provided for selective connection to the load and exercise stations, the five cable ends comprising opposite ends of the second and third cables and the first end of the first cable.

13. The machine as claimed in claim 12, wherein the first end of the second cable is connected to the load and the first cable has a 4:1 resistance ratio with the load.

14. The machine as claimed in claim 13, wherein the other end of the second cable is connected to one of the exercise stations.

15. The machine as claimed in claim 13, including at least one cable tie-off, the other end of the second cable being connected to the cable tie-off.

16. The machine as claimed in claim 13, wherein both ends of the third cable are connected to exercise stations.

17. The machine as claimed in claim 13, including at least one cable tie-off, one end of the third cable being connected to one of the exercise stations and the other end of the third cable being connected to the cable tie-off.

18. The machine as claimed in claim 13, wherein the first pulley unit has a third pulley pivotally secured to the pulley housing beneath the side-by-side pulleys for rotation about a third pulley axis, and the first cable extends around the third pulley to provide two cable ends each having a 2:1 resistance ratio for selective connection to exercise stations.

19. The machine as claimed in claim 1, wherein a third floating pulley unit separate from the second floating pulley unit is connected to the second floating pulley unit in a vertically stacked arrangement, the second cable extending between the second and third pulley units, the third floating pulley unit having at least one pulley, the second cable extending around one of the pulleys in at least one of the second and third pulley units, and a fourth cable extending around said one pulley of the third pulley unit, whereby at least five cable ends are provided for selective connection to the load and exercise stations.

20. The machine as claimed in claim 19, wherein one end of said fourth cable is connected to the load.

21. The machine as claimed in claim 20, wherein the other end of said fourth cable is connected to one of the exercise stations.

22. The machine as claimed in claim 21, wherein at least one end of the third cable and one end of the first cable are each connected to one of the exercise stations.

23. The machine as claimed in claim 19, wherein the third floating pulley unit has an upper pulley and a lower pulley pivotally mounted in the housing in a vertically spaced arrangement, the fourth cable extending around the upper pulley and the second cable extending around the lower pulley of the third floating pulley unit.

24. The machine as claimed in claim 1, wherein the first cable has a resistance at least four times that at one end of the third cable.

25. The machine as claimed in claim 1, wherein there are at least three exercise stations, one of said cable ends being linked to the load and the other three cable ends being connected to respective exercise stations and providing pulling points at predetermined resistance ratios with the load, at least two of the pulling points having different resistance ratios with the load.

26. The machine as claimed in claim 25, wherein on of the pulling points has a resistance which is double that of another pulling point.

27. The machine as claimed in claim 25, wherein the pulling points have resistance ratios of 1:2, 1:1, and 2:1 with the load, respectively.

28. The machine as claimed in claim 1, including four exercise stations, the cable and pulley assembly having at least four cable ends connected to the respective exercise stations and providing pulling points at predetermined resistance ratios with the load, at least three of the pulling points having different resistance ratios.

* * * * *

UNITED STATES PATENT AND TRADEMARK OFFICE

CERTIFICATE OF CORRECTION

PATENT NO. : 5,951,444

DATED : September 14, 1999

INVENTOR(S) : Randall T. Webber

It is certified that error appears in the above-indentified patent and that said Letters Patent is hereby corrected as shown below:

Column 8, claim 9, line 48, delete "is"

Column 10, claim 26, line 21, replace "on" with -one-;

Signed and Sealed this

Twentieth Day of March, 2001

Nicholas P. Godici

*Attest:*

NICHOLAS P. GODICI

*Attesting Officer*

*Acting Director of the United States Patent and Trademark Office*